United States Patent [19]

Pruett

[11] Patent Number: 4,854,542

[45] Date of Patent: Aug. 8, 1989

[54] CONCRETE COLUMN FORM

[76] Inventor: M. B. Pruett, 4599 Trails Dr., Sarasota, Fla. 34232

[21] Appl. No.: 252,908

[22] Filed: Oct. 3, 1988

[51] Int. Cl.[4] ..... E04G 13/02

[52] U.S. Cl. ..... 249/48; 249/51; 249/156; 249/173; 249/213

[58] Field of Search ..... 249/17, 48, 49, 50, 249/51, 95, 97, 135, 143, 156, 173, 213

[56] References Cited

U.S. PATENT DOCUMENTS

| | | | |
|---|---|---|---|
| 881,183 | 3/1908 | Guyer | 249/48 |
| 975,135 | 11/1910 | Kelsey et al. | 249/51 |
| 1,170,049 | 2/1916 | Cunningham | 249/219.1 |
| 1,201,613 | 10/1916 | Novy | 249/48 |
| 1,282,200 | 10/1918 | DesLauriers | 149/48 |
| 1,398,412 | 11/1921 | Barteschat | 249/134 |
| 2,093,346 | 9/1937 | Badt | 249/48 |
| 3,588,027 | 6/1971 | Bowden | 249/48 |

FOREIGN PATENT DOCUMENTS

| | | | |
|---|---|---|---|
| 3516259 | 1/1986 | Fed. Rep. of Germany | 249/173 |
| 641027 | 1/1962 | Italy | 249/48 |

*Primary Examiner*—James Housel

*Attorney, Agent, or Firm*—Charles J. Prescott

[57] ABSTRACT

A concrete column form structured to receive concrete therein for hardening into a building column having a curvilinear exterior surface. The form includes at least two form portions having a flat, thin generally rectangular sheet of resilient material and an elongated, rigid, straight edge bar connected along opposing side margins of each sheet. Each sheet is flexible by manipulation into a curvilinear configuration along its length by opposing rotation and inward movement of each of its connected edge bars. Connected together in side-by-side fashion along adjacent edge bars, the plurality of curvilinear-configured form portions complete the form itself. Both cylindrical and tapered building columns may be easily fabricated either in place or in a factory utilizing this invention.

8 Claims, 2 Drawing Sheets

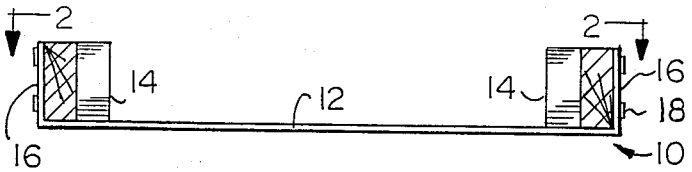
FIG. 1
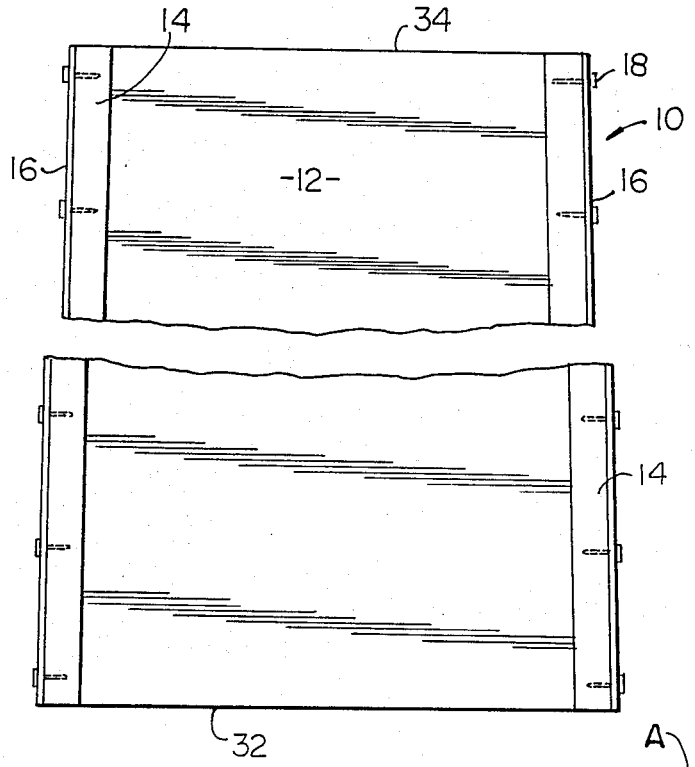
FIG. 2
FIG. 3
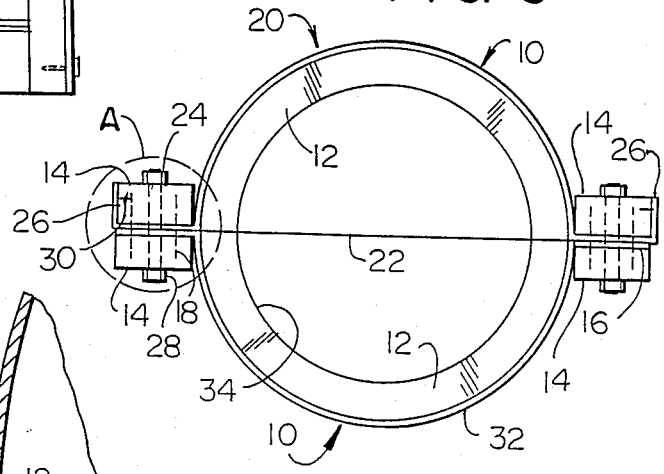
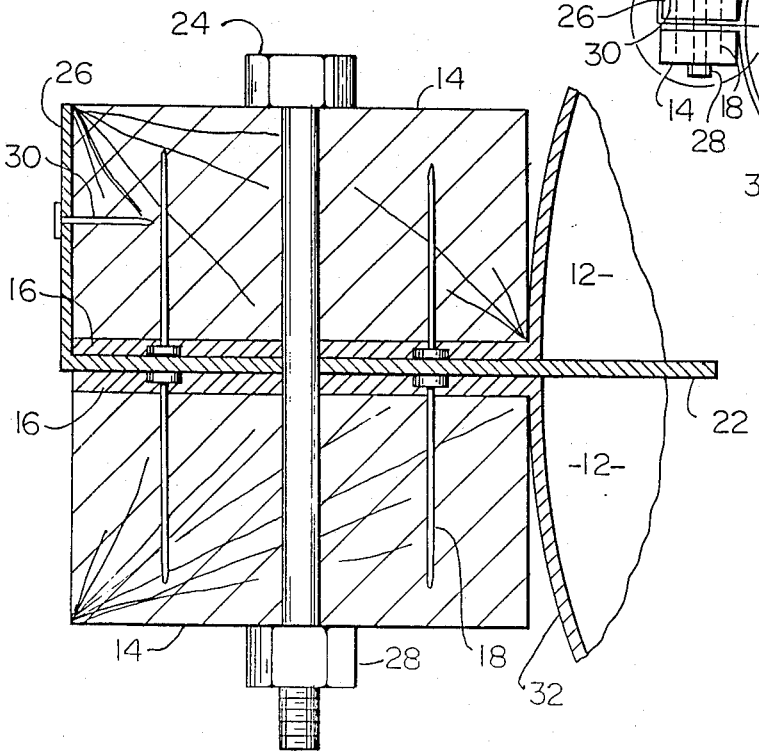
FIG. 4

CONCRETE COLUMN FORM

BACKGROUND OF THE INVENTION

This invention relates generally to building columns, and more particularly to a novel concrete column form for both on-site and factory casting of both straight and tapered concrete building columns.

In designing and building both residential and commercial structures, many architects incorporate decorative building columns to form the facade or entryway of such structures. Both rigid, reusable and disposable forms are well-known and currently available to construct such columns. Applicant is aware of the following U.S. patents which describe some of these similar well-known structures:

U.S. Pat. No. 881,183 to Guyer

U.S. Pat. No. 1,398,412 to Barkschat

U.S. Pat. No. 2,093,346 to Badt

Applicant is also aware of the disposable rigid column forms formed of a length of spiral-wound metal strip welded or otherwise seam connected along mating edges of the spiral wrapping and used to cast form the desired concrete column in place, after which the form is destroyed during removal.

The present invention provides an inexpensive, easily storable and reusable column form adapted to cast virtually any length concrete column and to also cast such columns having a curvilinear surface, circular, oval or irregular in cross section, and either cylindrical or tapered.

BRIEF SUMMARY OF THE INVENTION

This invention is directed to a concrete column form structured to receive concrete therein for hardening into a building column having a curvilinear exterior surface. The form includes at least two form portions having a flat, thin generally rectangular sheet of resilient material and an elongated, rigid, straight edge bar connected along opposing side margins of each sheet. Each sheet is flexible by manipulation into a curvilinear configuration along its length by opposing rotation and inward movement of each of its connected edge bars. Connected together in side-by-side fashion along adjacent edge bars, the plurality of curvilinear-configured form portions complete the form itself. Both cylindrical and tapered building columns having circular, oval or irregular cross sections may be easily fabricated either in place or in a factory utilizing this invention.

It is therefore an object of this invention to provide a building column form which is economical to manufacture and to store in the flat.

It is another object of this invention to provide a building column form which is adaptable to both cylindrical and tapered building columns of virtually any length desired.

It is yet another object of this invention to provide a building column form which is conveniently reusable.

It is yet another object of this invention to provide a building column form having a wide variety of curvilinear cross sections.

In accordance with these and other objects which will become apparent hereinafter, the instant invention will now be described with reference to the accompanying drawings in which:

BRIEF DESCRIPTION OF THE DRAWINGS

FIG. 1 is an end elevation view of the preferred embodiment of one half or one form portion of the invention.

FIG. 2 is a top plan view in the direction of arrows 2—2 in FIG. 1.

FIG. 3 is an end elevation view of the preferred embodiment of the invention assembled and ready for use.

FIG. 4 is an enlarged section view through region A in FIG. 3.

DETAILED DESCRIPTION OF THE INVENTION

Figure 5:
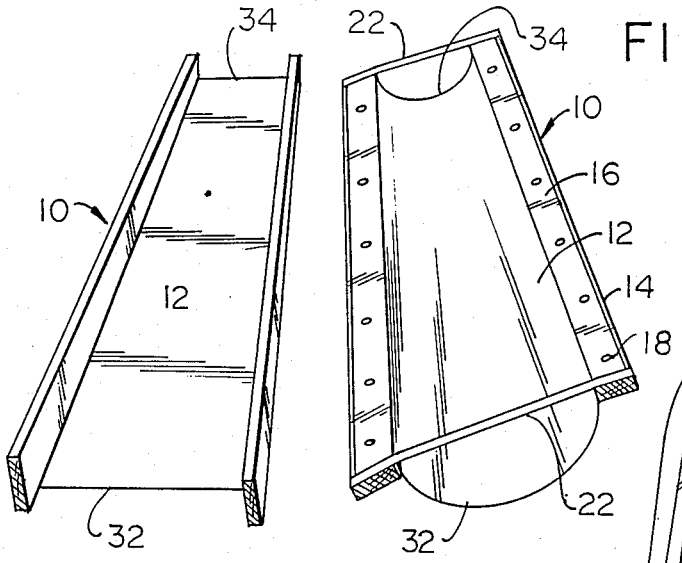
FIG. 5 is a perspective view of the two halves or form portions of the preferred embodiment of the invention, one in the flat and the other configured for use.

Referring now to the drawings and particularly to FIGS. 1 and 2, one-half of the preferred embodiment of the invention or one form portion is shown at numeral 10, the entire invention comprising a pair thereof. The form portion 10 includes a sheet 12 of flexible, resilient, thin sheet metal which has been bent through 90° to form opposing side panels 16. Each side panel 16 is adapted to mate and be connected against one side of an elongated, slender and generally straight-edge bar 14. In the preferred embodiment, these edge bars 14 are fabricated of wood, specifically a 2"×4". These edge bars 14 are connected by common nails 18 to side panels 16 as shown.

In the preferred embodiment 10, the sheet 12 is generally rectangular; however, the side panels 16 are nonparallel one to another, tapering from longer end 32 toward narrower end 34 of sheet 12. Note that sheet 12 is formed in the flat to facilitate nesting and storing of the mating form portions 10.

Referring additionally to FIGS. 3, 4, 5 and 6, the preferred embodiment of the invention is shown generally at numeral 20 in its assembled, ready to use configuration. To effect assembly of the two form portions 10 into the configuration as best seen in FIG. 3, edge bars 14 must be rotated through approximately 90° while moving them somewhat together so that the sheet 12 is resiliently contoured or flexed into the curvilinear surface as shown. To facilitate the initial resilient bending or forming of this first of sheets 12 of one of the form portions 10, a retention strap 22 formed of a length of thin metal strapping is also provided. This retention strap 22 is held by common nails 30 driven through the ends 26 of retention strap 22 into one edge of edge bars 14 as best seen in FIG. 4.

Figure 6:
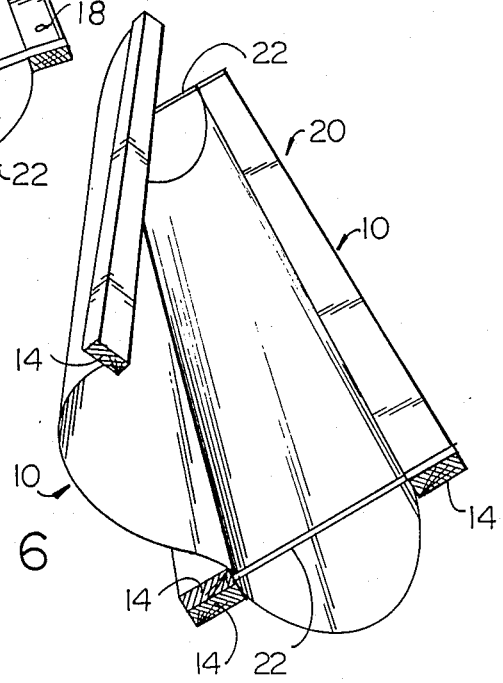
FIG. 6 is a perspective view of the preferred embodiment of the invention partially configured for use.

The preferred method of installing retention straps 22 is in spaced fashion along the entire length of one form portion 10, or at least at each end thereof as best seen in FIGS. 5 and 6. One end 26 or retention strap 22 is first nailed into the edge of one edge bar 14, after which sheet 12 is flexed into a semi-circular or right circular arch segment through approximately 180°. Held in this configuration, the opposite end 26 of strap 22 is then nailed into the edge of the remaining edge bar 14 by nails 30.

After one of form portions 10 is thusly reconfigured and held by retention straps 22 as best seen in FIG. 5, two mating edge bars 14 are then bolted together in side-by-side fashion by threaded fastener 24 and nut 28 as best seen in a combination of FIGS. 4 and 6. Thereafter, the remaining free edge bars 14 on each of the form portions 10 are brought together opposingly and bolted by additional threaded fasteners 24 and nuts 28.

It is here noted that the length of retention straps 22 and the positioning of its ends 26 are preferably chosen so that the form 20, when assembled, achieves a right circular cross section. To retain this shape during the actual casting of the column when the form 20 is in its upright orientation, retention straps 22 are left in place embedded within the concrete as it cures. Uniform outward pressure by the concrete against the sheets 12 maintains a uniform cross section. After formation of the concrete column itself, the form portions 10 may be removed by removing threaded fasteners 24 and nuts 28 and by pulling nails 30 from edge bars 14. The portions of retention strap 22, including ends 26, which extend outwardly from the concrete column may then be easily removed by cutting or fracturing the portion extending therefrom.

Two important further notes are made here. First, although at least one retention strap 22 is desirable to achieve a right circular cross section for the form 20, it may be made either longer or shorter to achieve a uniform oval cross section or may be eliminated in its entirety. In such event, a non-uniform column or oval-type cross section will be obtained during the casting of the concrete column or, alternately, an external bracing arrangement may be provided to replace the functional benefits of the retention straps 22. Secondly, although the preferred embodiment is fabricated of a pair of form portions 10, extending in curvilinear fashion through 180° of the periphery of the concrete column section, particularly in larger applications, the form 20 itself may be fabricated of more than two form portions 10 to reduce the weight and bulkiness and to facilitate assembly.

Figure 7:
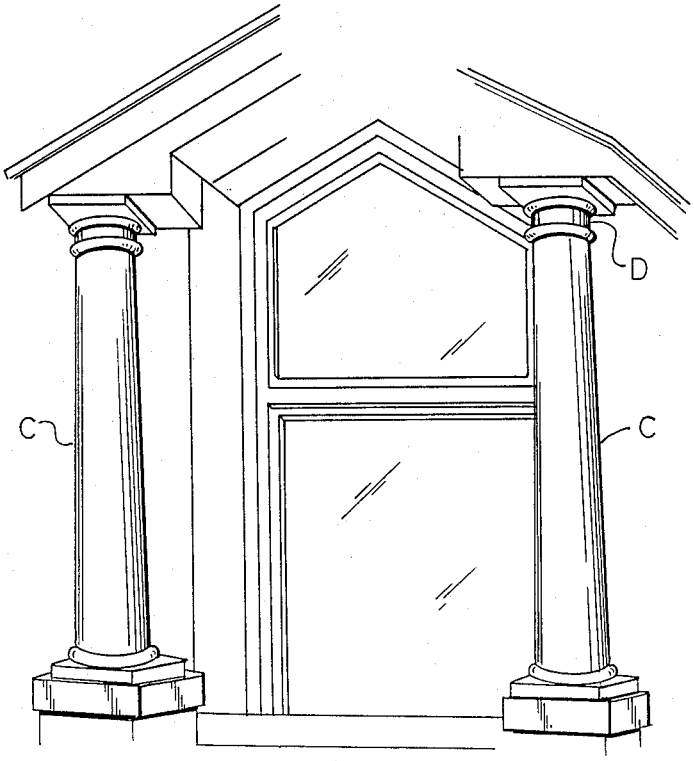
FIG. 7 is a pictorial view of the entryway of a home including two building columns which have been fabricated in place utilizing the present invention.

Referring now to FIG. 7, two concrete columns C are there shown having been cast formed in place utilizing the present invention. These concrete columns C were formed to be tapered upwardly and also include decorative additional structure D which may be added thereto as desired after the main concrete column C has been cast formed in place in accordance with this invention.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A concrete column form structured to supportively receive a quantity of uncured concrete for hardening therein into a building column, said form comprising:

a pair of mating form portions each including a generally flat and rectangular sheet of relatively thin, resilient material and an elongated, rigid, straight edge bar connected along, and generally coextensive with, opposing side margins of each said sheet;

each said sheet flexibly contoured from a first flat configuration for storage into a second configuration wherein said sheet forms a curvilinear surface along its length, said edge bar of one of said pair of mating form portions being rotated opposingly through approximately ninety degrees to said edge bar of the other of said pair of mating form portions;

at least one retention strap being connected transversely to said form portions between said edge bars for holding said form portions in said second configuration.

2. A concrete column form as set forth in claim 1, wherein:

said column form is right circular in transverse cross section and cylindrical;

said opposing side margins of each said sheet are parallel.

3. A concrete column form as set forth in claim 1, wherein:

said column form is right circular in transverse cross section and tapered;

said opposing side margins of each said sheet are nonparallel.

4. A concrete column form as set forth in claim 1, wherein:

each said sheet is fabricated of sheet metal.

5. A concrete column form structured to supportively receive a quantity of uncured concrete for hardening therein into a building column, said form comprising:

a plurality of at least three mating form portions each including a generally rectangular sheet of relatively thin, resilient material and an elongated, rigid, straight edge bar connected along, and generally coextensive with, opposing side margins of each said sheet;

each said sheet flexible contoured from a first flat configuration for storage into a second curvilinear configuration along its length as said edge bar of one of said pair of mating form portions is opposingly rotated to said edge bar of the other of said pair of mating form portions;

at least one retention strap being connected transversely to said form portions between said edge bars for holding said form portions in said second configuration.

6. A concrete column form as set forth in claim 5, wherein:

said column form is right circular in transverse cross section and cylindrical;

said opposing said margins of each said sheet are parallel.

7. A concrete column form as set forth in claim 5, wherein:

said column form is right circular in transverse cross section and tapered;

said opposing side margins of each said sheet are nonparallel.

8. A concrete column form as set forth in claim 5, wherein:

each said sheet is fabricated of sheet metal.

* * * * *